US009488142B2

(12) United States Patent
DeVito et al.

(10) Patent No.: US 9,488,142 B2
(45) Date of Patent: Nov. 8, 2016

(54) LOCATING PIN

(71) Applicant: INTERNATIONAL ENGINE INTELLECTUAL PROPERTY COMPANY, LLC, Lisle, IL (US)

(72) Inventors: Mark Rudolph DeVito, Columbia, SC (US); Gregory G. Hafner, Columbia, SC (US)

(73) Assignee: Internationa Engine Intellectual Property Comapny, LLC., Lisle, IL (US)

( * ) Notice: Subject to any disclaimer, the term of this patent is extended or adjusted under 35 U.S.C. 154(b) by 0 days.

(21) Appl. No.: 14/786,411

(22) PCT Filed: Apr. 22, 2013

(86) PCT No.: PCT/US2013/037571

§ 371 (c)(1),
(2) Date: Oct. 22, 2015

(87) PCT Pub. No.: WO2014/175857

PCT Pub. Date: Oct. 30, 2014

(65) Prior Publication Data

US 2016/0076502 A1 Mar. 17, 2016

(51) Int. Cl.

| | |
|---|---|
| ***F02M 61/04*** | (2006.01) |
| ***F02M 61/14*** | (2006.01) |
| ***F02M 63/00*** | (2006.01) |
| ***F02M 57/02*** | (2006.01) |
| ***F02M 61/16*** | (2006.01) |

(52) U.S. Cl.

CPC ..... *F02M 61/04* (2013.01); *F02M 57/025* (2013.01); *F02M 61/14* (2013.01); *F02M 61/168* (2013.01); *F02M 63/004* (2013.01); *F02M 63/0047* (2013.01); *F02M 63/0063* (2013.01); *F02M 2200/02* (2013.01); *F02M 2200/03* (2013.01); *F02M 2200/8053* (2013.01); *F02M 2200/85* (2013.01); *F02M 2200/852* (2013.01)

(58) Field of Classification Search

CPC .... F02M 61/04; F02M 61/14; F02M 61/168; F02M 57/02; F02M 57/022; F02M 57/025; F02M 63/0012; F02M 63/0031; F02M 63/004; F02M 63/0047; F02M 63/0059; F02M 63/0063; F02M 2200/02; F02M 2200/03; F02M 2200/80; F02M 2200/8053; F02M 2200/85; F02M 2200/852

See application file for complete search history.

(56) References Cited

U.S. PATENT DOCUMENTS

| | | | | |
|---|---|---|---|---|
| 4,572,433 A * | 2/1986 | Deckard | F02M 47/027 239/125 |
| 5,339,063 A * | 8/1994 | Pham | F02M 57/02 239/585.1 |
| 5,651,501 A * | 7/1997 | Maley | F02M 59/466 239/124 |
| 6,845,754 B2 | 1/2005 | Pecheny | |

(Continued)

*Primary Examiner* — Christopher Kim

(74) *Attorney, Agent, or Firm* — Jack D. Nimz; Jeffrey P. Calfa

(57) ABSTRACT

A fuel injector assembly has a control valve body and a plurality of end caps. End cap locating holes are formed into a mating surface of each end cap, and control valve body locating holes are formed into each mating surface of the control valve body. Locating pins inserted into the end cap and control valve body locating holes each have a fixed portion that affixes the locating pins to either the control valve body or the end cap. In the event of failure of a locating pin between the fixed portion and a free portion of the pins, the free portion maintains alignment of the control valve body locating holes with the end cap locating holes.

15 Claims, 5 Drawing Sheets

(56) References Cited

U.S. PATENT DOCUMENTS

2002/0109021 A1* 8/2002 Kiriki ..... F02M 47/027 239/533.3
2003/0121994 A1* 7/2003 Yudanov ..... F02M 65/005 239/533.9
2004/0046043 A1* 3/2004 Luedicke ..... F02M 57/025 239/88
2010/0219266 A1* 9/2010 Gebhardt ..... F02M 57/025 239/585.1
2016/0076502 A1* 3/2016 DeVito ..... F02M 63/0047 239/73

* cited by examiner 102
204
208
212
302
304
306
308
310
d1
d2
d3
d4
313
314
316
318
320
322
324
328
334
336
338
312

LOCATING PIN

BACKGROUND

Many modern fuel injectors use solenoids to move a spool valve or poppet valve located within the fuel injector into an open position, which allows a working fluid, such as oil, to flow into an intensifier chamber and compress fuel within a high-pressure chamber. The compressed fuel is then injected into the combustion chamber of the engine. During this process, fuel injectors experience tremendous forces. These forces result from a variety of sources, including the activation of the solenoids, high-pressure mixing and injection of reagents into the cylinder, and the rapid combustion of gases within the cylinder.

As will be described in more detail below, these forces can cause metal fatigue at various points on the fuel injector and result in failure or reduced performance of the fuel injector.

SUMMARY

According to one aspect, a fuel injector assembly comprises a plurality of end caps and a control valve body having a plurality of mating surfaces. Each end cap has a mating surface that is disposed to connect to a respective mating surface of the control valve body. Each of a plurality of locating pins have a pin length and a pin diameter. A plurality of end cap locating holes are formed into the mating surface of each end cap, and a plurality of control valve body locating holes are formed into each mating surface of the control valve body.

One of the plurality of end cap locating holes and the plurality of control valve body locating holes has a longitudinal axis, a first bore, and a second bore. The first bore has a first diameter so as to allow for fastening to a locating pin. The second bore has a second diameter that is larger than the first diameter. The second bore is on the longitudinal axis and is proximate to its respective mating surface. The first bore is also on the longitudinal axis but remote from its respective mating surface.

The other of the plurality of end cap locating holes and the plurality of control valve body locating holes has a third bore with a third diameter that is at least as large as the locating pin.

A fuel injector assembly comprises a plurality of end caps and a control valve body having a plurality of mating surfaces. Each end cap has a mating surface that is disposed to connect to a respective mating surface of the control valve body. A plurality of end cap locating holes are formed into the mating surface of each end cap, and a plurality of control valve body locating holes are formed into each mating surface of the control valve body.

Each of a plurality of locating pins has an affixed portion and a free portion. The affixed portion is fastened into one of the plurality of end cap locating holes and the plurality of control valve body locating holes.

In the event of breakage of the locating pin between the fixed portion and the free portion, the free portion of the locating pin maintains alignment of the control valve body locating holes with the end cap locating holes.

In another aspect, a fuel injector assembly comprises a control valve body having a plurality of mating surfaces, a plurality of end caps, with each end cap having a mating surface that is disposed to connect to a respective mating surface of the control valve body. A plurality of end cap locating holes are formed into the mating surface of each end cap, and a plurality of control valve body locating holes are formed into each mating surface of the control valve body. The assembly also includes a plurality of locating pins. One of the plurality of end cap locating holes and the plurality of control valve body locating holes is fastened to affixed portions of the plurality of locating pins.

The other of the plurality of end cap locating holes and the plurality of control valve body locating holes has a longitudinal axis, a first bore with a first diameter, and a second bore with a second diameter that is larger than the first diameter. The second bore is on the longitudinal axis and is proximate to its respective mating surface. The first bore is remote from its respective mating surface.

BRIEF DESCRIPTION OF THE DRAWINGS

Further aspects can be discerned in the following Detailed Description, in which like characters denote like parts and in which.

DETAILED DESCRIPTION

Figure 1:
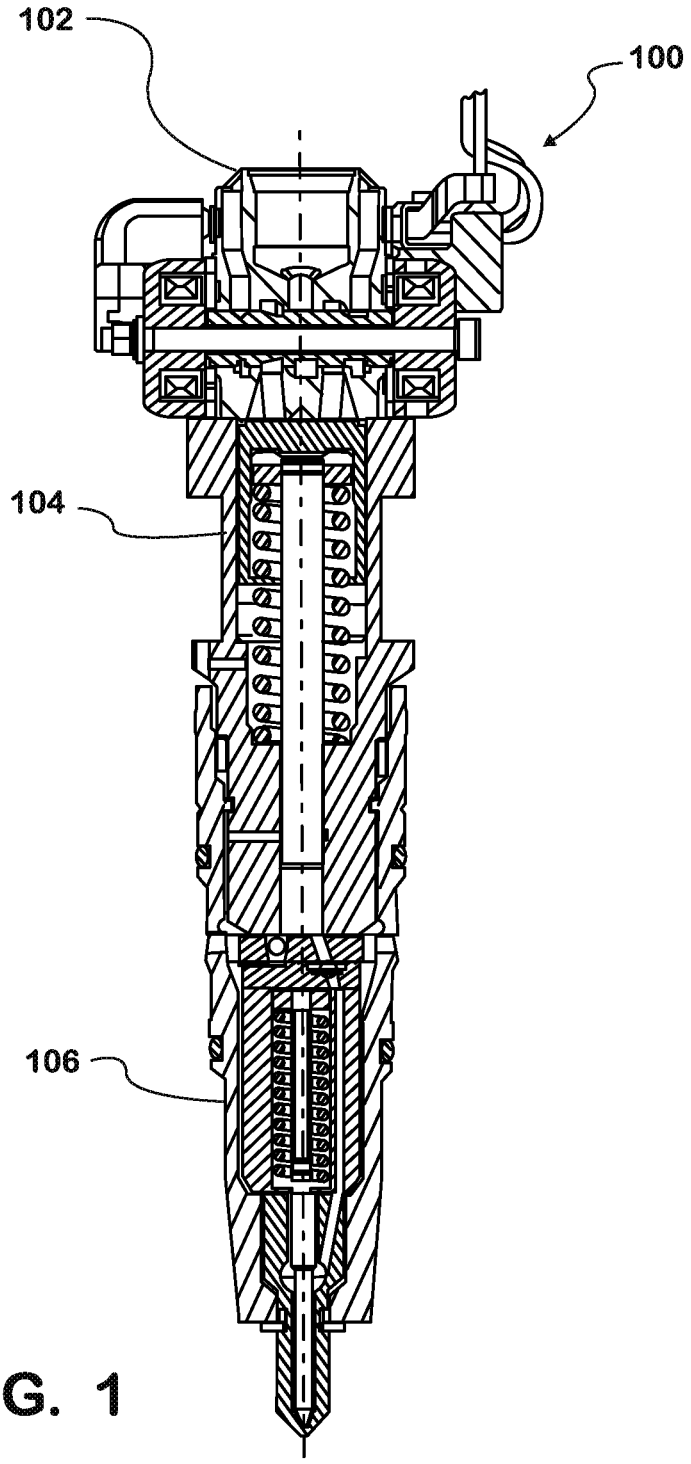
FIG. 1 is a cross sectional side view of a fuel injector.

FIG. 1 shows a fuel injector, indicated generally at 100. The fuel injector 100 has a control valve body 102, an intensifier body 104, and an injector assembly 106. The control valve body 102 controls the inlet and outlet of a pressurized fluid into the intensifier body 104, which, in turn, acts upon the injector assembly 106 to inject the reagents into the combustion cylinder (not shown).

Figure 2:
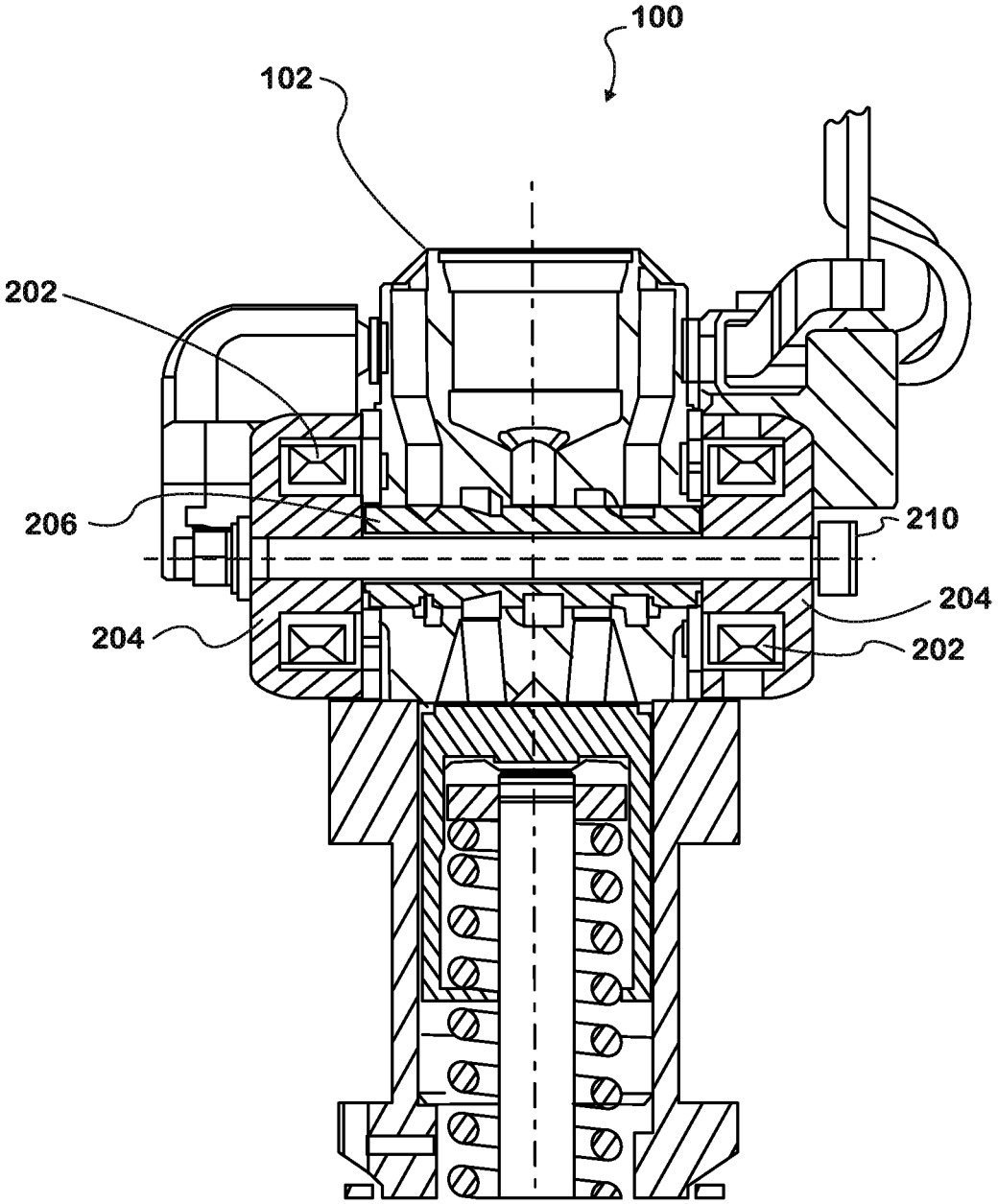
FIG. 2 is a cross sectional side view of an upper portion of a fuel injector assembly.

Referring to FIG. 2, solenoids 202 are mounted on opposite sides of the control valve body 102 and are covered by respective end caps 204. When actuated, the solenoids 202 energize to create a magnetic force that moves a spool 206 into either an open position or a closed position. The solenoids 202 operate in an alternating fashion, with one solenoid 204 acting to move the spool 206 into the open position and the other solenoid 204 acting to move the spool 206 into the closed position.

Figure 2A:
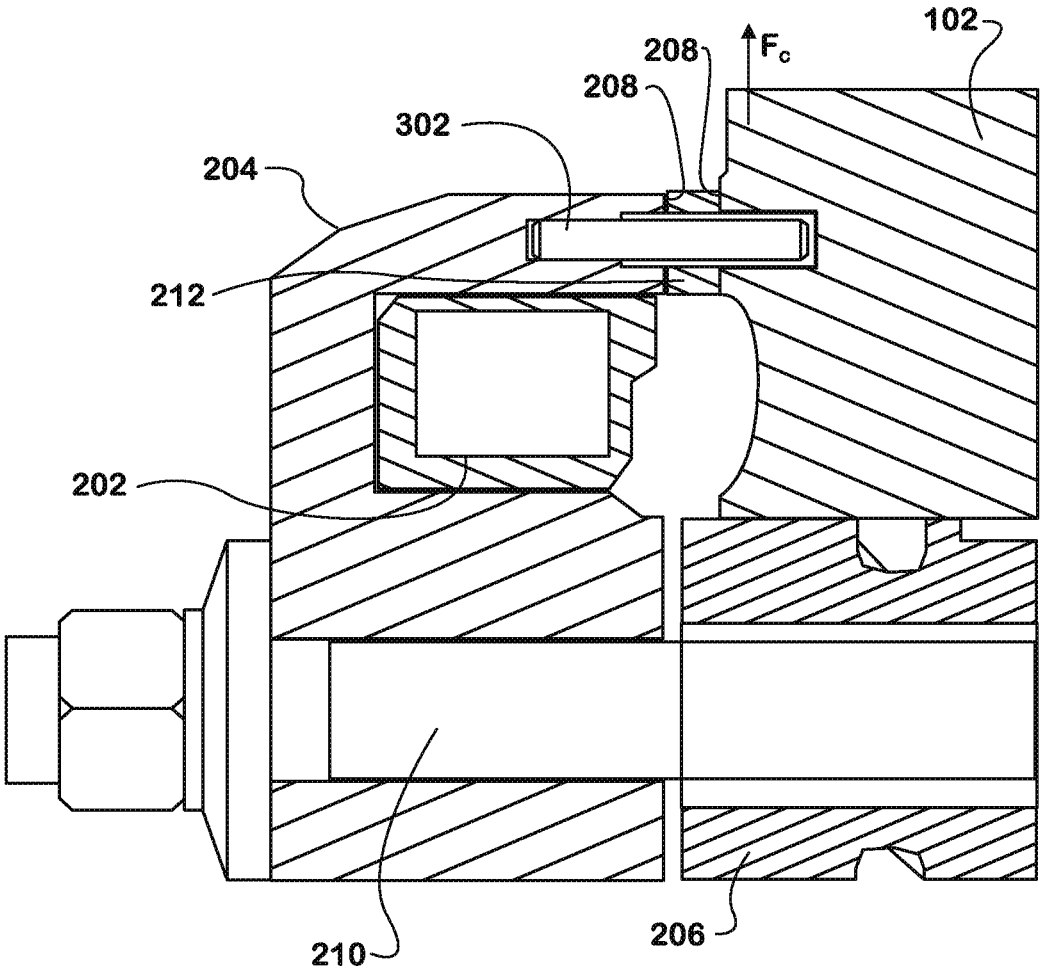
FIG. 2A is detail of the cross sectional side view of FIG. 2, showing a thru-rod, end cap, solenoid, control valve body, spool, and locating pin.
Figures 3A, 3B, 3C:
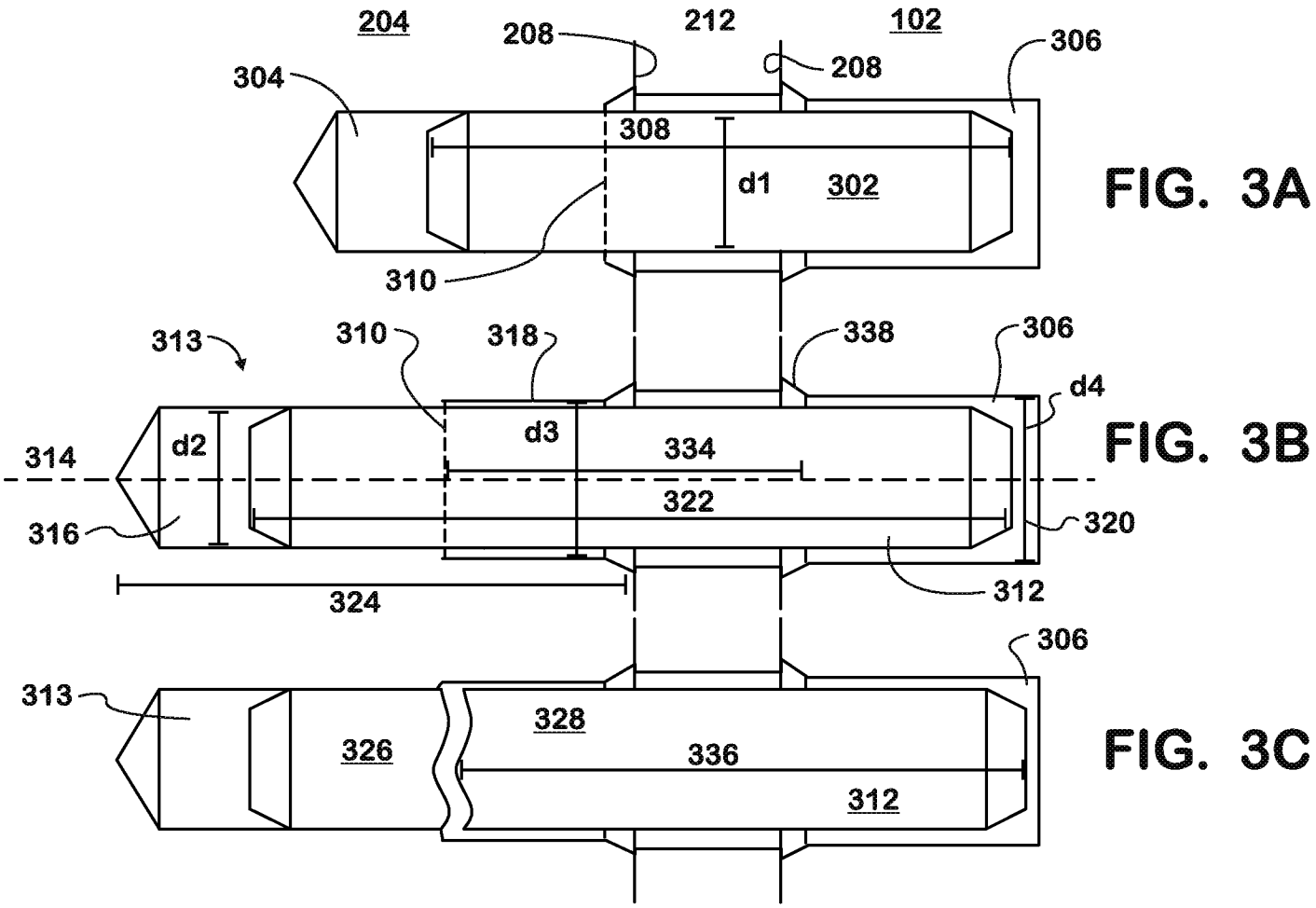
FIG. 3A is a cross sectional view of a locating pin affixing an end cap to a control valve body showing an end cap, a locating pin, a spacer, and a control valve body.
FIG. 3B is a cross sectional view of a locating hole and a locating pin affixing an end cap to a control valve body and showing an end cap, an elongated locating pin, a counter bore, a spacer, and a control valve body.
FIG. 3C is a cross sectional view of a locating hole and a locating pin affixing an end cap to a control valve body and showing an end cap, a broken elongated locating pin, a counter bore, a spacer, and a control valve body.

Referring to FIG. 2A, mating surfaces 208 of the end caps 204 are connected to corresponding mating surfaces 208 of the control valve body 102 with locating pins (see 302 of FIG. 3A). FIG. 2A shows that a spacer 212 is inserted between the respective mating faces 208 of the end cap 204 and the control valve body 102, but this is not necessarily so. In fact, it is specifically contemplated that the respective mating surfaces 208 of the end cap 204 and the control valve body 102 may directly abut one another.

A thru-rod 210 passes through the end caps 204, the solenoids 202, and the spool 206. Since the spool 206 repeatedly moves back and forth between the open and closed positions, the end caps 204 act as physical stops to prevent the spool 206 from traveling too far.

In order for the fuel injector 100 to have the necessary responsiveness, the spool 206 alternates between the open and the closed positions very rapidly. This means that the solenoids 202 act on the spool 206 with great force and results in powerful impacts of the spool 206 on the end caps 204. As the spool 206 impacts the end caps 204, the frictional forces between the end cap 204 and the control valve body 102 are momentarily reduced.

In addition, as the fluid pressurizes the intensifier body 104, the overall length of the fuel injector 100 increases, further increasing the stress on the locating pins 302. Further, once the reagents are injected into the cylinder (not shown), they form highly pressurized combusted gases. These highly pressurized gases exert large amounts of force, $F_c$, on the bottom of the fuel injector 100. Thus, as the frictional forces between the end caps 204 and the control valve body 102 are reduced due to the impact of the spool 206, the injector 100 experiences upward pressure from the cylinder, which places stress on the locating pins 302. As the combustion cycle repeats, the locating pins 302 experience repeated stress (see FIG. 2A), which, over time, causes the locating pins 302 to fail.

Once the locating pins 302 have failed, the end caps 204 and the thru-rod 210 may shift, causing the thru-rod 210 to interfere with the movement of the spool 206, which results in poor injector performance or failure of the injector 100 altogether.

FIG. 3A shows a control valve body 204 having a mating surface 208 and a control valve body 102 having a corresponding mating surface 208. As described above, a spacer 212 may or may not be inserted in between the two mating surfaces 208. A locating pin 302 is inserted into an end cap locating hole 304 and a control valve body locating hole 306 that have been formed into the respective mating surfaces 208 of the end caps 204 and the control valve body 102. A plurality of end cap locating holes 304 and control valve body locating holes 306 are formed into the respective mating surfaces 208.

The locating pin 302 has a pin length 308, typically about 5 mm, and a pin diameter $d_1$. In previous designs, the pin 302 usually fails at a failure point 310 where the pin 302 is attached, typically through press fitting, to the end cap locating hole 304.

FIG. 3B show an elongated locating pin 312 that has been inserted into an elongated end cap locating hole 313 having a pin length 322. The end cap locating hole 313 has a longitudinal axis 314, a first bore 316 with a diameter $d_2$ that allows for the affixation of the locating pin 312. The end cap locating hole 313 has a second bore 318 with a diameter $d_3$ that is larger than the diameter $d_2$ of the first bore 316. The second bore 318 is on the longitudinal axis 314 and is proximate to the mating surface 208 of the end cap 204. The first bore 316 is on the axis 314 and remote from the mating surface 208.

FIG. 3B shows a control valve body locating hole 306 with a third bore 320 having a diameter $d_4$ formed into the control valve body 102. The diameter $d_4$ is at least as large as the pin diameter $d_1$.

In operation, the elongated pin 312 and the counter bore 318 have proven to be more durable and reliable than the design shown in FIG. 3A for two reasons. First, in the event of movement of the control valve body 102 in relation to the end cap 204, the locating pin 312 experiences edge stress around the surface of the pin 312. The counter bore 318 and the increased pin length 322 allow that edge stress to be distributed over a longer length of the pin 312, rather than being concentrated at the failure point 310. This allows the pin 312 to bend and flex more than the design shown in FIG. 3A. FIG. 3B has shows that the pin 312 has an effective length 334 which extends approximately from the failure point 310 to the first point of contact with the body 102. In this case, the first point of contact with the body 102 is at the end of a chamfer 338, which may be disposed to be adjacent the second bore 318 proximate to the mating surface 208.

Second, in the event of failure of the pin 312 into a fixed portion 326 and a free portion 328, the additional length of the pin 312 allows the free portion 328 having a free length 336 to maintain alignment of the control valve body locating hole 306 with the end cap locating hole 313. See FIG. 3C. Additionally, the free portion 328 of the pin 312 is able to rotate because the diameters $d_3$ and $d_4$ of the second bore 318 and third bore 306, respectively, are larger than the diameter $d_1$ of the pin 312. Thus, successive impacts are distributed over the entire surface of the free end 328 of the pin 312, resulting in longer life of the fuel injector 100.

The pin length 322 may be between approximately 5.5 mm and approximately 12 mm. More specifically, the pin length 322 may be approximately 7 mm. A total bore length 324 of the first and second bores 316, 318 may be between approximately 4.4 mm and approximately 10.0 mm. Thus, when assembled, the locating pin 312 may extend beyond the total bore length 324 of the first and second bores 316, 318 by at least 3 mm to assure alignment of the locating holes 306, 313 in the event of a failure.

It is important to note that, while the illustrated embodiments and the discussion above show and discuss the use of a counter bore, i.e. second bore 318, with respect to the end cap 204, it is contemplated that the reverse configuration can also be used. Thus, an end of the elongated pin 312 may be affixed into a first bore (not shown) of the control valve body locating hole 306 and the counter bore may be bored into the control valve body locating holes.

Figure 3D:
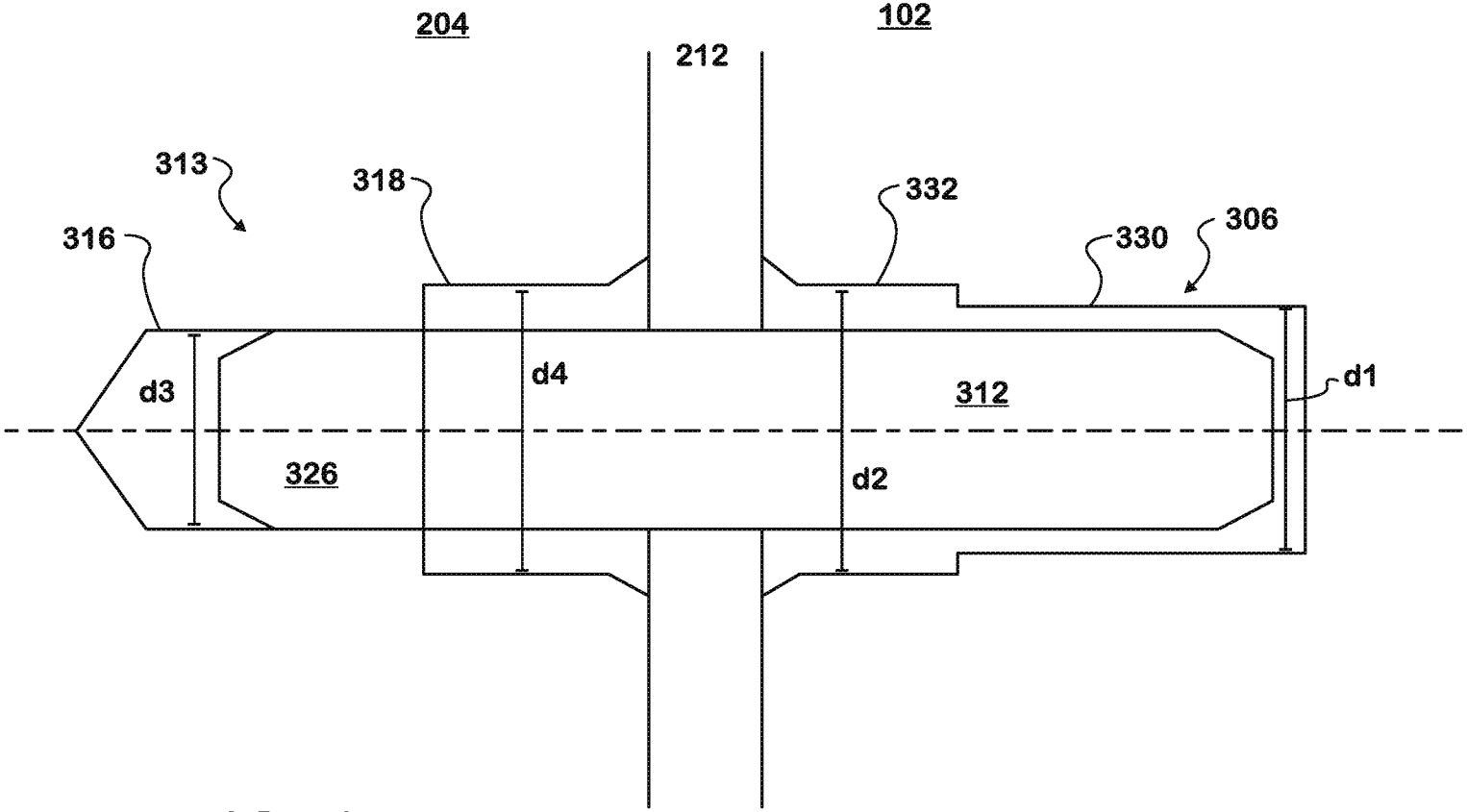
FIG. 3D is a cross sectional view of a locating hole and a locating pin affixing an end cap to a control valve body showing an end cap, a spacer, a control valve body, and two counter bores.

FIG. 3D shows that one of the plurality of end cap locating holes 313 and the plurality of control valve body locating holes 306 is fastened to the affixed portions 326 of the locating pins 312. The other of the plurality of end cap locating holes 313 and the plurality of control valve body locating holes 306, i.e. the side not affixed to the locating pin, may have a second bore 332, or counter bore, of a second diameter $d_2$, which is larger than the diameter $d_1$ of the first bore 330. This increases the effective length of the pin 312, which also increases it durability. FIG. 3D also shows that both the plurality of end cap locating holes 313 and the plurality of control valve body locating holes 306 may have a second bore 318, or counter-bore, further increasing the effective length of the pin 312.

In summary, the described apparatus provide increased durability and reliability of the fuel injectors. Additionally, the apparatus can be installed as part of remanufacturing designs without requiring re-testing the efficiency of the fuel injectors themselves, making it an attractive option for engine manufacturers.

100—fuel injector assembly;
102—control valve body;
104—intensifier body;
106—injector assembly;
202—solenoid;

204—end cap;
206—spool;
208—mating surface;
210—thru-rod;
212—spacer;
302—locating pin;
304—end cap locating holes;
306—control valve body locating holes;
308—pin length;
310—failure point;
312—locating pin;
313—end cap locating hole;
314—axis;
316—first bore;
318—second bore;
320—third bore;
322—pin length;
324—total bore length;
326—fixed portion;
328—free portion;
330—first bore;
332—second bore;
334—effective length;
336—free length; and
338—chamfer.

We claim:

1. A fuel injector assembly, comprising:
a control valve body having a plurality of mating surfaces;
a plurality of end caps, each end cap having a mating surface disposed to connect to a respective mating surface of the control valve body;
a plurality of locating pins, each locating pin having a pin length and a pin diameter;
a plurality of end cap locating holes formed into the mating surface of each end cap; and
a plurality of control valve body locating holes formed into each mating surface of the control valve body;
one of the plurality of end cap locating holes and the plurality of control valve body locating holes having a longitudinal axis, a first bore with a first diameter so as to allow for fastening to a locating pin, and a second bore with a second diameter larger than the first diameter, the second bore being on the longitudinal axis and proximate to its respective mating surface, the first bore being remote from its respective mating surface; and
the other of the plurality of end cap locating holes and the plurality of control valve body locating holes having a third bore with a third diameter being at least as large as the pin diameter.

2. The fuel injector assembly of claim 1, wherein the pin length has a range of between approximately 5.5 millimeters and approximately 12 millimeters.

3. The fuel injector assembly of claim 2, wherein the pin length is approximately 7 millimeters.

4. The fuel injector assembly of claim 1, wherein a total bore length of the first and second bores has a range of between approximately 4.4 millimeters and approximately 10.0 millimeters.

5. The fuel injector assembly of claim 1, wherein a locating pin extends beyond a total bore length of the first and second bores by at least 3 millimeters.

6. The fuel injector assembly of claim 1, further comprising a spacer disposed between the mating surface of the end caps and the mating surfaces of the control valve body.

7. The fuel injector assembly of claim 1, wherein the first and second bores are formed into the end cap locating holes.

8. The fuel injector assembly of claim 1, further comprising a chamfered surface adjacent the second bore to be proximate to the respective mating surface.

9. The fuel injector assembly of claim 1, wherein the third diameter of the third bore is larger than the second diameter of the second bore.

10. A fuel injector assembly, comprising:
a control valve body having a plurality of mating surfaces;
a plurality of end caps, each end cap having a mating surface disposed to connect to a respective mating surface of the control valve body;
a plurality of end cap locating holes formed into the mating surface of each end cap;
a plurality of control valve body locating holes formed into each mating surface of the control valve body;
a plurality of locating pins, each locating pin having an affixed portion and a free portion, the affixed portion being fastened into one of the plurality of end cap locating holes and the plurality of control valve body locating holes;
wherein, in the event of breakage of the locating pin between the fixed portion and the free portion, the free portion of the locating pin maintains alignment of the control valve body locating holes with the end cap locating holes.

11. The fuel injector assembly of claim 10, wherein the fixed portions of the locating pins are fastened into the plurality of end cap locating holes.

12. The fuel injector assembly of claim 10, further comprising a spacer disposed between the mating surface of the end caps and the mating surfaces of the control valve body.

13. The fuel injector assembly of claim 10, wherein, in the event of breakage of the locating pin, the free portion of the locating pin is able to rotate within end cap locating hole and the control valve body locating hole.

14. A fuel injector assembly, comprising:
a control valve body having a plurality of mating surfaces;
a plurality of end caps, each end cap having a mating surface disposed to connect to a respective mating surface of the control valve body;
a plurality of end cap locating holes formed into the mating surface of each end cap;
a plurality of control valve body locating holes formed into each mating surface of the control valve body; and
a plurality of locating pins;
one of the plurality of end cap locating holes and the plurality of control valve body locating holes being fastened to affixed portions of the plurality of locating pins;
the other of the plurality of end cap locating holes and the plurality of control valve body locating holes having a longitudinal axis, a first bore with a first diameter, and a second bore with a second diameter larger than the first diameter; the second bore being on the longitudinal axis and proximate to its respective mating surface, the first bore being remote from its respective mating surface.

15. The fuel injector assembly of claim 14, wherein the one of the plurality of end cap locating holes and the plurality of control valve body locating holes further comprises a third bore with a third diameter and a fourth bore with a fourth diameter larger than the third diameter, the fourth bore being on the longitudinal axis and proximate to its respective mating surface, the third bore being remote from its respective mating surface.

* * * * *